United States Patent [19]

Shimko

[11] Patent Number: 4,931,803

[45] Date of Patent: Jun. 5, 1990

[54] ELECTRONICALLY STEERED PHASED ARRAY RADAR ANTENNA

[75] Inventor: Steve R. Shimko, Ellicott City, Md.

[73] Assignee: The United States of America as represented by the Secretary of the Army, Washington, D.C.

[21] Appl. No.: 176,123

[22] Filed: Mar. 31, 1988

[51] Int. Cl.[5] ..... H01Q 3/22

[52] U.S. Cl. ..... 342/371

[58] Field of Search ..... 342/371, 372, 377

[56] References Cited

U.S. PATENT DOCUMENTS

| | | | |
|---|---|---|---|
| 4,143,378 | 3/1979 | Darrouzet | 342/371 |
| 4,656,463 | 4/1987 | Anders et al. | 340/572 |
| 4,688,045 | 8/1987 | Knudsen | 342/377 |

*Primary Examiner*—Gregory C. Issing

*Attorney, Agent, or Firm*—Freddie M. Bush; Howard G. Garner

[57] ABSTRACT

An electronically steered phased array antenna system. The system includes a phased array radar antenna having a microwave phased shifter for inserting a predetermined amount of path delay into each of the radiated elements of the antenna. It also includes a beam steering controller connected to the microwave phase shifter which is adapted to control the phase shifter according to predetermined parameters relating to the antenna to maximize its performance. An electronically erasable programmable read only memory device is disposed on the antenna itself for storing the predetermined parameters relating to the antenna. The memory device is connected to the controller and by inputting its data into the memory of the controller converts the controller from a generic device to a dedicated controller for the antenna in question. The memory device can be reprogrammed without removing it from the antenna for changes in the antenna configuration data.

3 Claims, 1 Drawing Sheet

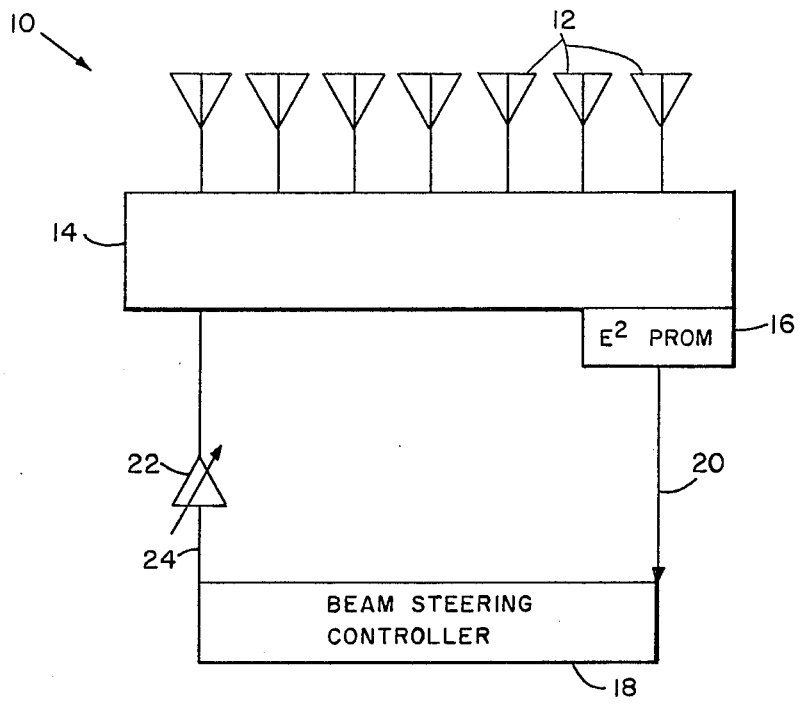
10
12
14
E2 PROM
16
22
20
24
BEAM STEERING
CONTROLLER
18

ELECTRONICALLY STEERED PHASED ARRAY RADAR ANTENNA

DEDICATORY CLAUSE

The invention described herein may be manufactured, used, and licensed by or for the U.S. Government for governmental purposes without the payment to me of any royalties thereon.

BACKGROUND OF THE INVENTION

This invention relates to electronically steered phased array antennas, and in particular to those where the beam forming and shaping functions of the phased array antenna is performed by microwave phase shifters.

In electronically steered phased array antennas, where the beam forming and shaping functions is performed by microwave shifters, the shifters insert a given amount of path delay (phase shift) into each radiating element. The amount of the delay is a function of the beam pointing angle and the beam shape desired. A dedicated computational device, usually referred to as a beam steering controller computes the individual phase shift commands for each phase shifter and outputs this information to the phase shifter.

A phase shifter driver is located between the beam steering controller and each phase shifter. The phase shifter driver is a voltage level translation and power amplifier device which is used to generate the proper drive signals for the phase shifter itself. The phase shifter and phase shifter driver combination is sometimes referred to as a phase control module.

An advantage to electronically steered phased array antennas is that they can be calibrated, or tuned by adjusting the phase shift command of each phase control module. This calibration is needed to compensate for manufacturing variations such as the physical path length differences, phase controlled module insertion phase differences, phase shift variations due to temperature fluctuations, antenna mounting misalignment, and the like. These tuning correction factors are typically stored in the beam steering controller in a non-volatile memory. In operation they are used to modify the phase shift command to each phase control module so as to maintain the desired beam pointing direction and beam shape despite variations in the above mentioned parameters.

The storage of these parameters in the beam steering controller has caused significant configuration control problems with attendant lost time and increased cost. The reason for this is that once a beam steering controller has had a particular antenna's tuning parameters programmed into it, the beam steering controller is no longer a generic piece of hardware. The dedicated beam steering controller must always accompany the particular antenna, and cannot be used with another antenna until the beam steering controller is reprogrammed with that antenna's tuning parameters. Furthermore, at times, the data for the wrong antenna is programmed into the beam steering controller, causing degraded antenna performance.

SUMMARY OF THE INVENTION

It is an object of the invention to provide an electronically steered phased array radar antenna system.

It is another object of the invention to provide an electronically steered phased radar system, wherein the tuning parameters of the antenna are stored on an electronically erasable programmable read only memory, disposed on the antenna itself.

The objects of the invention are obtained by providing an electronically erasable programmable read only memory ($E^2$PROM) on each antenna which contain the essential tuning parameters of the antenna. This memory may be reprogrammed while it is mounted on the antenna itself and can be selectively or entirely erased and rewritten if it becomes necessary to change any of the characterization data for the antenna, such as might become necessary upon the failure of a phase control module. The beam steering controller is connected to the electronically erasable programmable read only memory by means of a data link, thus the characterization data is transferred to a beam steering controller in an "off-line" manner and stored in the high speed access memory of the beam steering computer. This data can then be used, as required, in the beam computation process at full speed. This permits the beam steering control to remain a universal, generic controller which is identical for all antennas. Configuration control is thus simplified because all antenna specific data is contained as part of the antenna itself.

BRIEF DESCRIPTION OF THE DRAWINGS

The invention will now be described in conjunction with the attached drawing, in which:

The single Figure is a schematic illustration of the electronically steered phased array antenna system of the invention.

DETAILED DESCRIPTION OF THE DRAWING

Referring now to the Figure of the drawing which illustrates an electronically steered phased array antenna system of the invention. This system comprises a phased array antenna 10 which has a plurality of elements 12 supported on a base 14. The antenna illustrated herein is schematically illustrated but represents any of innumerable antennas available to the art wherein the elements are electronically steered in a phased array relationship.

Mounted on the base 14 is an electronically erasable programmable read only memory 16 ($E^2$ PROM) which is connected to the beam steering controller 18 by means of a serial data link 20. The electronically erasable programmable read only memory 16 has stored therein all of the parameters specific to antenna 10 and feeds those parameters to the beam steering controller 18, which may comprise a generic microprocessor, thereby converting the controller 18 to a dedicated controller for antenna 10. Controller 18 is connected to antenna 10 by means of a data link 24 which feeds through a phase control module 22.

By using the electronically erasable programmable read only memory 16, it is possible to selectively or entirely erase and rewrite the memory should it become necessary to change any of the characterization data for antenna 10. Such a change would become necessary if phase control module 22 has to be replaced due to failure or for any other reason.

The beam steering controller 18 interfaces with the characterization memory 16 through a simple low cost serial data link 20. In this way, the characterization data can be transferred into the beam steering controller in an "off-line" manner and be stored in the high speed random access memory of the controller and used, as required, in the beam computation process. The computation process then can be done at full speed. This allows the beam steering controller to remain a generic piece of equipment, which is identical for all antennas.

The configuration data specific for each antenna is stored as part of the antenna itself. Since some of the factors that cause antenna characterization variability, such as temperature, change relatively slowly and it is not necessary to transfer all such characterization data from the antenna to the beam steering controller at one time. Instead temperature dependent data can be transferred as needed, thereby reducing the memory requirements in the beam steering controller itself.

While one embodiment of the invention has been described hereinabove, it will be appreciated that the system of the invention is applicable to all electronically steered phased array antenna systems and that the invention is not limited to any specific form of the antenna. The scope of the invention will be defined by the claims appended hereto.

I claim:

1. An electronically steered phased array antenna system for radar systems, which is calibrated and tuned to compensate for manufacturing variations such as the phase control module insertion difference, phase shift variation due to temperature fluctuations, and antenna mounting misalignment, comprising:

(a) a phased array radar antenna having a microwave phase shifter for inserting a predetermined amount of path deplay into each radiating element of said antenna, the amount of which is a function of the beam pointing angle and the beam shape;

(b) a beam steering controller connected to said microwave phase shifter, and comprising means to control said phase shifter to calibrate and tune said antenna to compensate for manufacturing variations such as the phase control module insertion difference, phase shift variations due to temperature fluctuations, and antenna mounting misalignment specifically relating to said antenna;

(c) an electronically erasable programmable read only memory device disposed on said antenna for storing predetermined data parameters relating to said manufacturing variations; and (d) a serial data link between said electronically erasable programmable read only memory device and said controller for adjusting said microwave phase shifter in accordance with said calibration said tuning data.

2. An electronically steered phased array antenna system as set forth in claim 1, wherein said beam steering controller comprises a microprocessor.

3. An electronically steered phased array antenna system as set forth in claim 1, wherein said predetermined parameters stored in said memory device can be modified without removing said device from said antenna.

* * * * *